United States Patent [19]

Streich

[11] 4,067,358

[45] Jan. 10, 1978

[54] INDEXING AUTOMATIC FILL-UP FLOAT VALVE

[75] Inventor: Steven G. Streich, Duncan, Okla.

[73] Assignee: Halliburton Company, Duncan, Okla.

[21] Appl. No.: 646,284

[22] Filed: Jan. 2, 1976

Related U.S. Application Data

[62] Division of Ser. No. 597,376, July 18, 1975, Pat. No. 4,014,727.

[51] Int. Cl.[2] ..... F16K 31/12

[52] U.S. Cl. ..... 137/624.13; 137/624.27; 137/515; 251/230

[58] Field of Search ..... 137/624.27, 624.13, 137/515, 515.3, 515.5, 515.7, 522, 523; 251/230; 166/224 R, 224 A, 225, 285

[56] References Cited

U.S. PATENT DOCUMENTS

| | | | |
|---|---|---|---|
| 2,802,482 | 8/1957 | Arnbold | 137/515 X |
| 3,220,695 | 11/1965 | Downey | 251/230 X |
| 3,807,428 | 4/1974 | Watkins | 137/624.27 X |

*Primary Examiner*—Alan Cohan

*Attorney, Agent, or Firm*—John H. Tregoning; James R. Duzan

[57] ABSTRACT

A valve for repetitively allowing and preventing upward fluid flow through a casing string. The valve is convertible from a locked open position permitting reverse upward fluid flow therethrough to a check valve position preventing upward fluid flow therethrough by flowing fluid downwardly through the casing to actuate an indexing J-slot mechanism interconnecting the spring-loaded valve member and the valve body assembly. The valve may be recycled to the locked open position from the check valve position an unlimited number of times through the flowing of fluid in a forward direction downwardly through the casing string.

18 Claims, 13 Drawing Figures

INDEXING AUTOMATIC FILL-UP FLOAT VALVE

This is a division of application Ser. No. 597,376, filed July 18, 1975, now Pat. No. 4,014,727 issued Mar. 29, 1977.

BACKGROUND OF THE INVENTION

1. Field of the Invention

This invention relates generally to improvements in check valves, and more particularly, but not by way of limitation, to fluid flow-actuated check valves for use in float collars or float shoes in well cementing operations.

2. Description of the Prior Art

The prior art contains a number of teachings of flow control check valves for use in floating equipment employed in the cementing of casing in oil wells. It is normally desirable to maintain the check valves in an open condition in the float shoes or float collars of the casing as the casing is being run into the well so that the casing can automatically fill from the bottom at a predetermined rate in order to save costly rig time which would otherwise be expended in manually filling the casing string from the surface as it is being run into the borehole. Currently available tool designs for such floating equipment are limited by some form of sacrificial mechanical part for maintaining the check valve in an open position such as shear plates, shear pins, extrusion rings, tension collars or the like. Such mechanical items must have a calculated strength such that the check valve is held open until a predetermined amount of pressure differential or a predetermined fluid flow rate acts upon the tool. The reliability of such prior art designs depends upon whether or not the materials being deformed or sheared perform in the predicted manner. If the materials do not perform in the predicted manner, the check valve member may either be released prematurely or may not be released at all. The elimination of sacrificial mechanical devices would be a distinct advantage.

It should also be noted that the currently available tool designs for automatically filling float shoes or float collars provide no means for reopening and reclosing the check valve employed therein after the deformation or shearing of the sacrificial mechanical part previously maintaining such check valve in an open position. This structural limitation in the prior art devices eliminates the possibility of testing the check valve mechanism for operability when in position down hole prior to commencing the actual cementing operation.

Those forms of automatic filling float shoes or float collars which require a ball or plug to be dropped through the casing string to seal in the valve mechanism of the float shoe or float collar to seal off the valve mechanism so that pressure can be applied thereto to release the locked open check valve through shearing or deformation of a sacrificial mechanical part are characterized by a disadvantageous time delay during which the ball or plug must fall through the fluid in the casing. Prior art mechanisms of this type are illustrated at pages 2412 and 2413 of the Halliburton Services Sales and Service Catalog No. 37.

It will be clearly seen that all forms of prior art tool designs discussed above prevent the possibility of reverse circulation through the check valve mechanism once release of the check valve has been obtained through shearing or extruding the sacrificial mechanical part previously maintaining the check valve in an open position.

U.S. Pat. Nos. 3,776,250 and 3,385,372, each granted to Lloyd C. Knox, and U.S. Pat. No. 3,385,370, granted to Lloyd C. Knox, et al., all of which are assigned to Halliburton Company, the assignee of the present invention, disclose various forms of prior art flow control valve structures employing frangible pins and otherwise deformable elements. A non-indexing automatic fill-up valve utilizing shear pins is shown on pages 2414 and 2415 of Halliburton Services Sales and Service Catalog No. 37.

SUMMARY OF THE INVENTION

The present invention contemplates a flow responsive fluid check valve for controlling forward and reverse fluid flow through a conduit. The valve comprises a valve body having a substantially longitudinally aligned passage therethrough and means for connecting the valve body in a conduit. A valve seat is disposed in the valve body facing in the direction of foward fluid flow therethrough. The valve further includes valve member means, movably disposed in the valve body for engaging the valve seat to close the valve to reverse fluid flow and, alternately, for disengaging from the valve seat to open the valve to reverse fluid flow. The valve also includes biasing means operatively engaging the valve member means for urging the valve member means into engagement with the valve seat. The valve further comprises flow responsive means operatively, mutually engaging the valve body and the valve member means for retaining the valve member means disengaged from the valve seat against the urging of the biasing means to thereby allow reverse fluid flow through the valve body, for releasing the valve member means for engagement with the valve seat under the urging of the biasing means in response to an application of forward fluid flow through the valve body to thereby prevent reverse fluid flow therethrough, and for again retaining the valve member means disengaged from the valve seat against the urging of the biasing means in response to another application of forward fluid flow through the valve body to thereby again allow reverse fluid flow therethrough.

Objects and advantages of the present invention will be readily apparent from the following detailed description when read in conjunction with the accompanying drawings.

DESCRIPTION OF THE PREFERRED EMBODIMENT

Figure 1A:
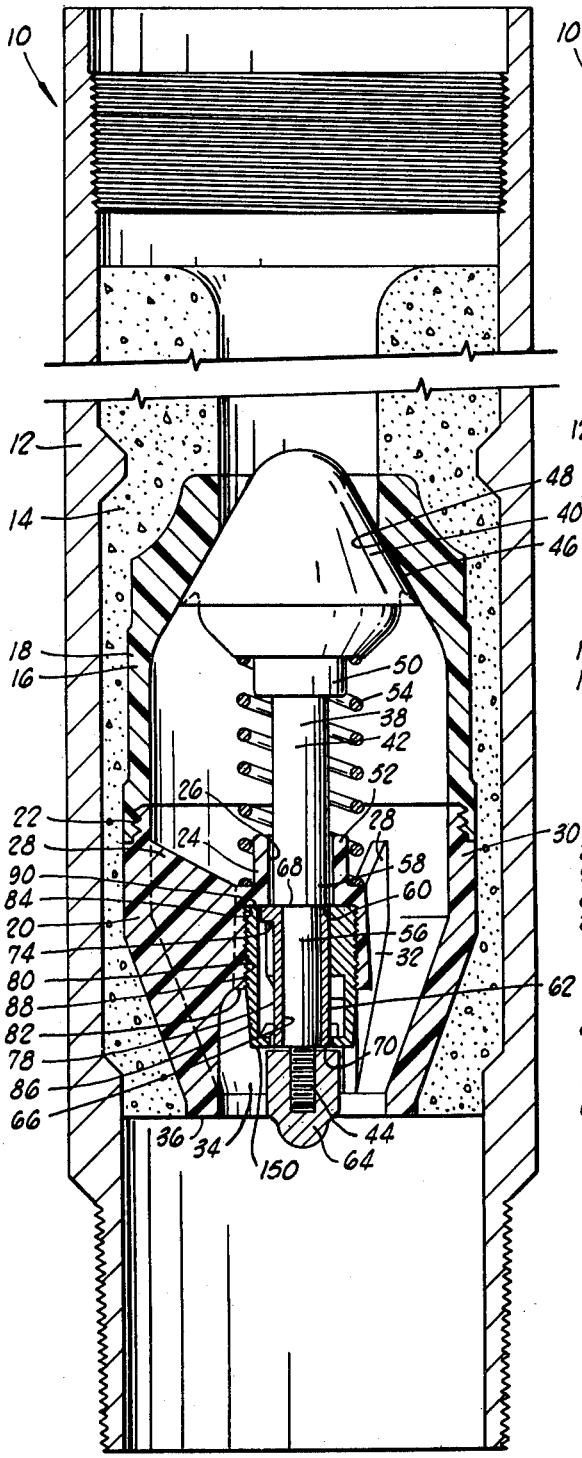
FIGS. 1A is a partial vertical cross-sectional view of an indexing J-slot automatic fill-up valve apparatus constructed in accordance with the present invention illustrating the valve member in the closed position.
Figure 1B:
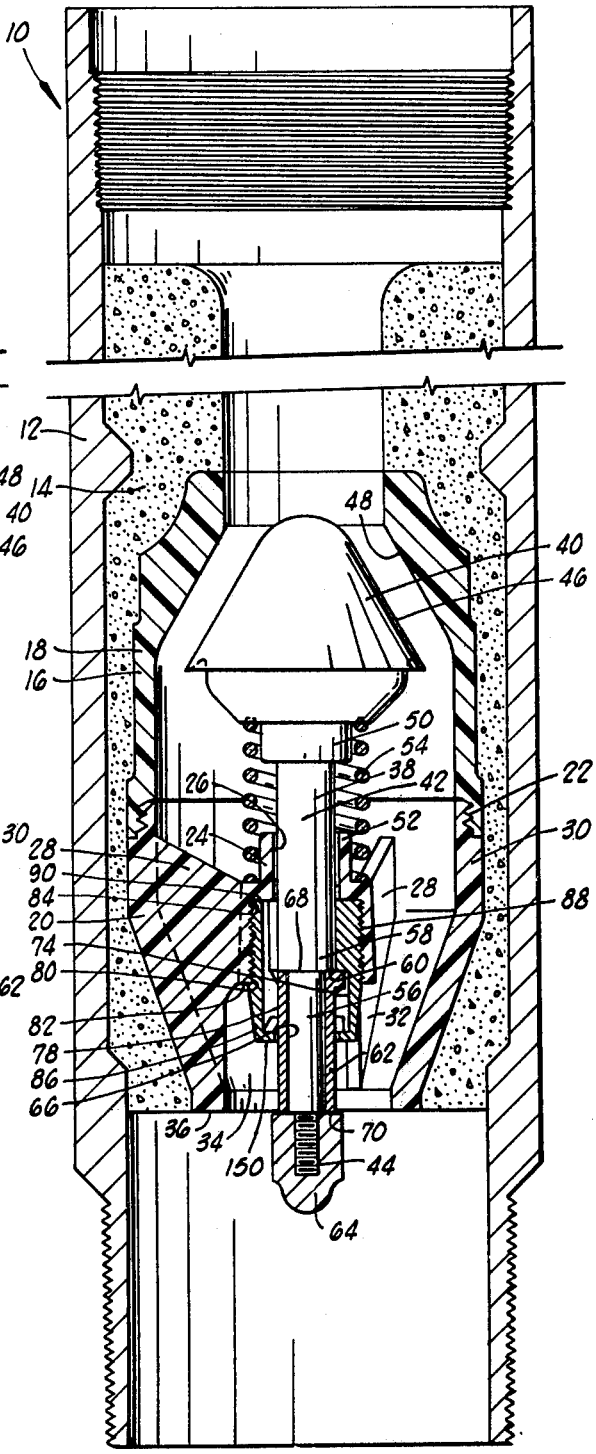
FIG. 1B is a partial vertical cross-sectional view of the indexing J-slot automatic fill-up valve apparatus of FIG. 1A illustrating the valve member in the open position.

Referring now to the drawings, and to FIGS. 1A and 1B in particular, a float collar constructed in accordance with the present invention is illustrated and is generally designated by the reference character 10. The float collar 10 comprises an outer cylindrical housing 12 formed of a durable material such as steel. Centered within the housing 12 and supported by a drillable concrete filler portion 14 is a tubular valve body assembly 16 comprising an upper valve body 18 and a lower valve body 20 joined together by a releasable connection such as matching threads 22.

The lower valve body 20 includes a valve guide 24 formed as an integral part thereof and having a longitudinal passage 26 extending vertically therethrough coaxial with the tubular valve body assembly 16 and the housing 12. The valve guide 24 is supported by one or more vanes 28 extending between the valve guide 24 and the outer wall 30 of the lower valve body 20. The vanes 28 further define one or more flow ports 32 extending longitudinally through the lower valve body 20. A lower recessed central opening 34 is formed in the lower valve body 20 and communicates between the lower end face 36 and the flow ports 32 thereof. In the preferred embodiment, the lower valve body 20 comprises three equally circumferentially spaced vanes 28 defining three equally circumferentially spaced flow ports 32.

A valve body 38, comprising a plunger head 40, a valve stem 42 axially aligned with the tubular valve body assembly and an externally threaded portion 44 formed on the lower end of the valve stem 42, is longitudinally slidably supported within the valve body assembly 16 by the valve guide 24 with the valve stem 42 extending through the longitudinal passage 26. The plunger head 40 includes a substantially conical valve surface 46 which matches a downwardly facing upper valve seat 48 formed in the upper valve body 18. The conical valve surface 46 preferably carries an elastomeric covering to provide enhanced sealing engagement between the plunger head 40 and the valve seat 48.

The plunger head 40 further includes an integral collar 50 formed on the lower portion thereof coaxial with the valve stem 42 and having an outer diameter substantially equal to the outer diameter of the upper portion 52 of the valve guide 24. A compression coil spring 54 extends between the upper portion 52 of the valve guide 24 and the lower portion of the plunger head 40 to apply a constant upward biasing force to the valve member 38 urging the plunger head 40 thereof toward the valve seat 48 to achieve sealing engagement therebetween.

A first cylindrical outer surface 56 is formed on the valve stem 42 and extends upwardly from the threaded portion 44 thereof. The first cylindrical outer surface 56 communicates with a second cylindrical outer surface 58 formed on the valve stem 42 via an annular radial shoulder 60. A tubular indexing sleeve 62 is journaled on the first cylindrical outer surface 56 of the valve stem 42 intermediate the annular shoulder 60 and an internally threaded nut 64 threadedly secured to the externally threaded portion 44 of the valve stem 42. The tubular indexing sleeve 62 is adapted to freely rotate about the longitudinal axis of the valve stem 42.

Figure 5:
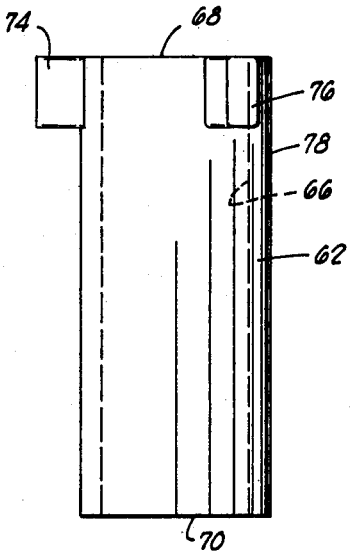
FIG. 5 is an enlarged vertical elevation view of the indexing sleeve of the fill-up valve apparatus of FIG. 1A.
Figure 6:
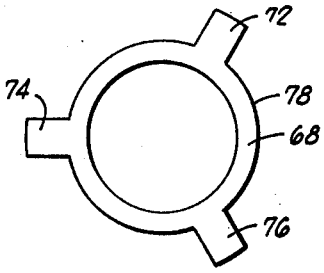
FIG. 6 is a top plan view of the indexing sleeve of FIG. 5.

As more clearly shown in FIGS. 5 and 6, the tubular indexing sleeve 62 includes a cylindrical bore 66 extending longitudinally therethrough communicating with the upper and lower end faces 68 and 70. Radially outwardly extending cam follower portuberances or lugs 72, 74 and 76 are formed on the cylindrical outer periphery 78 of the tubular indexing sleeve 62 and are equally circumferentially spaced about the outer periphery 78. The annular circumferential spacing between adjacent cam follower lugs is 120°.

The longitudinal passage 26 of the valve guide 24 includes an internally threaded portion 80 which extends upwardly from the lower end face 82 and communicates with an annular shoulder 84 formed in the longitudinal passage 26.

A tubular J-slot insert 86 having external threads 88 formed thereon is threadedly secured in the internally threaded portion 80 of the longitudinal passage 26 of the valve guide 24 with the upper end face 90 thereof abutting the annular shoulder 84 of the longitudinal passage 26.

Figure 2:
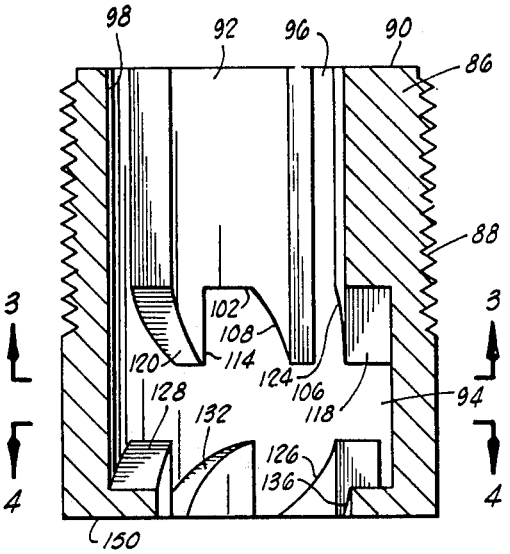
FIG. 2 is an enlarged vertical cross-sectional view of the J-slot insert of the automatic fill-up valve apparatus of FIG. 1A.
Figure 3:
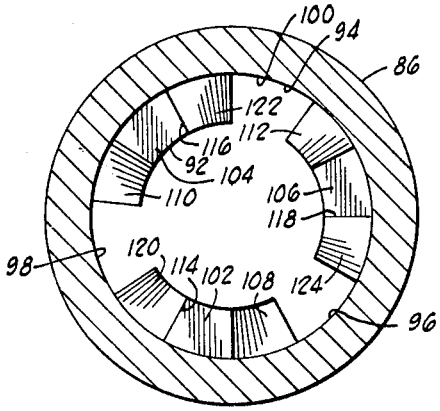
FIG. 3 is a horizontal cross-sectional view taken along line 3—3 of FIG. 2.
Figure 4:
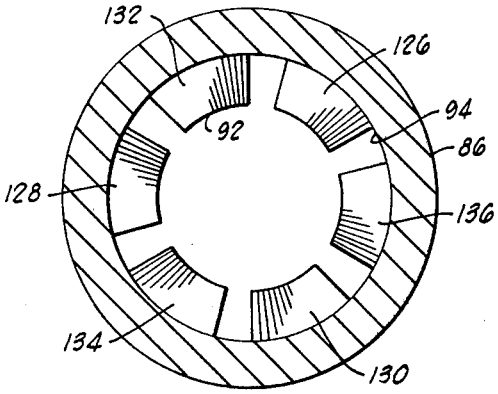
FIG. 4 is a horizontal cross-sectional view taken along line 4—4 of FIG. 2.

As more clearly shown in FIGS. 2, 3 and 4, the J-slot insert 86 includes a substantially cylindrical inner surface 92 in which is formed a continuous cam slot 94. The cam slot 94 includes three longitudinally aligned portions 96, 98 and 100, which communicate with the upper end face 90, and three circumferentially equally spaced detent portions 102, 104 and 106. Inclined surface 108 interconnects longitudinal portion 96 and detent portion 102. Inclined surface 110 interconnects longitudinal portion 98 and detent portion 104. Inclined surface 112 interconnects longitudinal portion 100 and detent portion 106. Longitudinal surfaces 114, 116 and 118 extend downwardly from detent portions 102, 104 and 106, respectively. An inclined surface 120 interconnects longitudinal surface 114 and longitudinal portion 98 of the continuous cam slot 94. Inclined surface 122 interconnects longitudinal surface 116 and longitudinal portion 100. Inclined surface 124 interconnects longitudinal surface 118 and longitudinal portion 96. This structure is more clearly shown in the planar projection of the continuous cam slot 94 illustrated in FIG. 7.

The continuous cam slot 94 further includes three upwardly facing inclined surface 126, 128 and 130 positioned directly below the longitudinal portions 96, 98 and 100, respectively. The continuous cam slot 94 further includes three additional upwardly facing inclined surfaces 132, 134 and 136 positioned directly below the detent portions 102, 104 and 106, respectively. Longitudinal surfaces 138, 140, 142, 144, 146 and 148 interconnect the lower end face 150 of the J-slot insert 86 with the upwardly facing inclined surfaces 126, 128, 130, 132, 134 and 136, respectively.

The float collar 10 is advantageously employed in oil well cementing. Oil well cementing is a process involving the mixing of a cement-water slurry and the pumping of the slurry down through steel casing positioned with an oil well borehole to critical points located in the annulus between the casing and the borehole, in the open hole below the steel casing or in fractured formations. The strain on the derrick caused by the weight of the casing string as it is being inserted into the borehole can be minimized through the employment of one or more float collars and/or a float shoe in the casing string to partially float the casing string to the bottom of the well in the well fluids contained therein. Casing flotation is accomplished when the well or drilling fluid in the well bore is either prevented from flowing upwardly through the float valve in the casing or the fluid is allowed to flow through the float valve structure at a predetermined restricted rate to automatically fill the casing from the bottom as it is being run into the well.

Figures 9, 10, 11, 12:
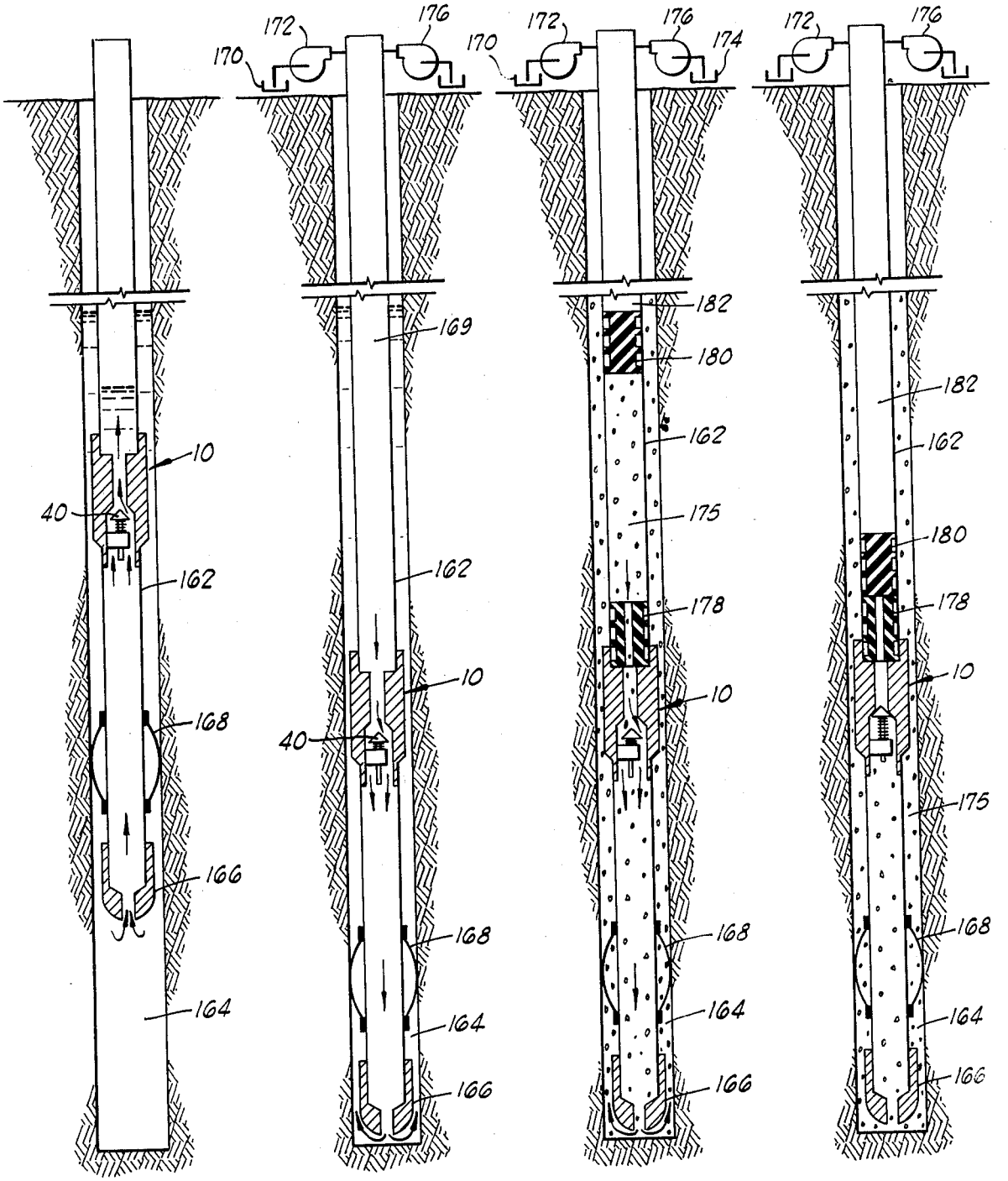
FIG. 9 is a vertical cross-sectional schematic view illustrating a float collar constructed in accordance with the present invention installed in a casing string being lowered into a well bore.
FIG. 10 is a vertical cross-sectional schematic view illustrating the casing string of FIG. 9 positioned in the well bore and the testing of the indexing automatic fill-up float valve in the float collar.
FIG. 11 is a vertical cross-sectional schematic view similar to FIG. 10 illustrating the introduction of cement slurry through the float collar to cement the casing string in the well bore.
FIG. 12 is a vertical cross-sectional schematic view similar to FIG. 11 illustrating the completion of the cementing operation with the indexing automatic fill-up float valve in the closed position preventing reverse upward flow of the cement slurry through the casing string.

In such cement operations, the float collar 10 is assembled as shown in FIG. 1B and is inserted in a casing string either at the lower end portion thereof or spaced one or two joints upwardly from the lower end portion thereof. FIG. 9 illustrates schematically a casing string 162 having a float collar 10 installed therein as it is being lowered into an oil well borehole 164 in which it is to be cemented. The casing string 162 includes a conventional guide shoe 166 mounted on the lower end thereof and a conventional casing centralizer 168 disposed about the casing string intermediate the guide shoe and the float collar 10. As the casing string is run into the well, the fluid in the barehole 164 passes upwardly through the guide shoe 166 and through the flow ports 32 in the tubular valve body assembly 16 of the float collar 10 at a predetermined rate dependent upon the cross-sectional area of the flow ports 32 and the hydrostatic head of the fluid in the borehole acting thereon.

It will be seen that as the casing string 162 is lowered into the borehole 164, the plunger head 40 of the valve member 38 is retained or locked out of engagement with the valve seat 48 thereby opening the tubular valve body assembly 16 to upward reverse fluid flow therethrough. The float collar 10 is maintained in this open position against the upward bias of the compressed compression coil spring 54 through the engagement of the cam follower lugs 72, 74 and 76 with the detent portions 102, 104 and 106 of the continuous cam slot 94 as shown in FIG. 1B and in FIG. 7 at the position indicated at A.

Figure 7:
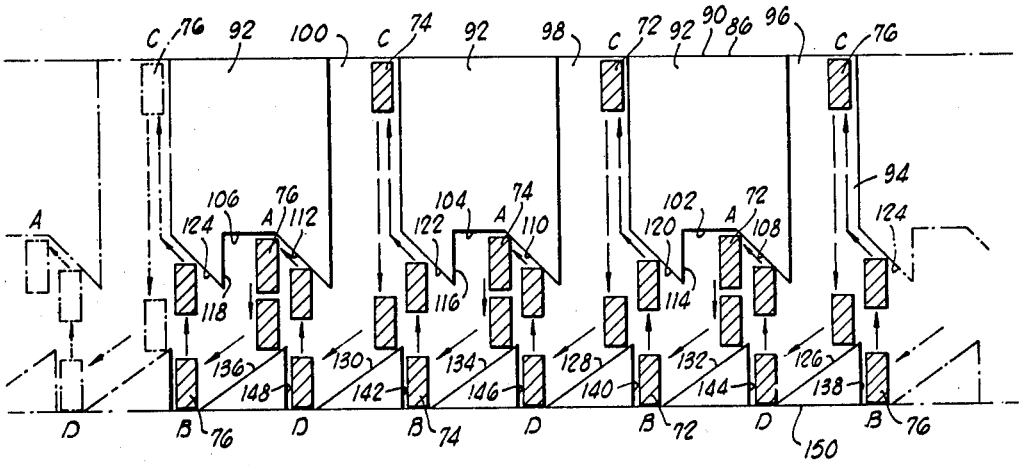
FIG. 7 is a planar projection of the continuous cam slot formed in the inner periphery of the J-slot insert of FIG. 2.

If, at any time during or after the descent of the casing string 162 into the borehole fluid, it is desired to close the valve apparatus of the float collar 10, this may be done by flowing displacement fluid 169 downwardly through the casing string 162 in a forward direction from reservoir 170 and pump 172 through the tubular valve body assembly 16 at a sufficient flow rate to move the valve member 38 downwardly from its retained open position, as shown in FIG. 10, thereby causing the cam follower lugs 72, 74 and 76 to engage the upwardly facing inclined surfaces 132, 134 and 136 of the cam slot 94 causing resulting rotation of the tubular indexing sleeve 62 relative to the valve stem 42 to the position indicated at B in FIG. 7. When fluid is no longer flowing downwardly through the casing string 162 at a rate sufficient to compress the coil spring 54, the coil spring 54 extends moving the valve member 38 upwardly until the plunger head 40 is free to sealingly engage the valve seat 48 and the cam follower lugs 72, 74 and 76 move upwardly along the longitudinal ports 98, 100 and 96 to the position indicated at C. The valve structure of the float collar 10 is then in the condition illustrated in FIG. 1A and operates as a check valve preventing upward reverse fluid flow through the tubular valve body assembly 16 while permitting downward forward fluid flow therethrough against the upward bias of the compression coil spring 54.

When it is again desired to position the valve structure of the float collar 10 in the locked open position with the valve member 38 retained against the bias of the compression coil spring 54, fluid is again flowed downwardly through the casing string 162, as shown in FIG. 10, at a flow rate sufficient to overcome the upward bias of the coil spring 54 thereby forcing the valve member 38 downwardly within the tubular valve body 16 until the cam follower lugs 72, 74 and 76 of the tubular indexing sleeve 62 engage the upwardly facing inclined surfaces 128, 130 and 126 thereby rotating the tubular indexing sleeve 62 relative to the valve stem 42 until the cam follower lugs and the tubular indexing sleeve 62 assume the position indicated at D. When downward fluid flow through the casing string 162 is stopped, the coil spring 54 extends and moves the valve member 38 upwardly within the tubular valve body 16 and the cam follower lugs 72, 74 and 76 of the indexing sleeve 62 engage the inclined surfaces 110, 112 and 108 of the cam slot 94 causing a resulting rotation of the tubular indexing sleeve 62 relative to the valve stem 42 until the cam follower lugs again engage the detent portions 102, 104 and 106 again, as shown at position A, thereby retaining the valve member 38 is an open position with the plunger head 40 out of engagement with the valve seat 48 thus permitting upward reverse fluid flow through the tubular valve body assembly 16 of the float collar 10. Such opening and closing of the valve structure of the float collar 10 may be repeated as many times as desired prior to commencing the cementing operation.

When the cementing operation commences, the cement slurry 175 is pumped downwardly through the casing string 162 from reservoir 174 by pump 176 behind bottom plug 178, as shown in FIG. 11, at a rate sufficient to again force the valve member 38 downwardly relative to the tubular valve body 16 causing the cam follower lugs 72, 74 and 76 to move from their retained positions at A to the positions indicated at B. When the bottom plug 178 abuts the float collar 10, differential pressure ruptures a diaphragm formed therein permitting the cement slurry 175 to pass therethrough. The rate of flow of the cement slurry through the tubular valve body 16 is sufficient to maintain the valve member 38 in its lowermost position compressing the coil spring 54 and thus maintaining the valve structure in an open position. A top plug 180 is inserted in the casing string 162 and follows the cement slurry 175, separating it from displacement fluid 182 pumped from reservoir 170 by pump 172 which forces the cement slurry downwardly until the top plug 180 engages the ruptured bottom plug 178 stopping further flow. When cement flow is stopped, the compression spring 54 urges the plunger head 40 of the valve member 38 into sealing engagement with the valve seat 48 thereby closing the tool against reverse upward flow of cement through the tubular valve body assembly 16 of the float collar 10 caused by the hydrostatic pressure applied by the column of cement in the annulus between the casing string 162 and the wall of the oil well borehole 164, as shown in FIG. 12.

Figure 8:
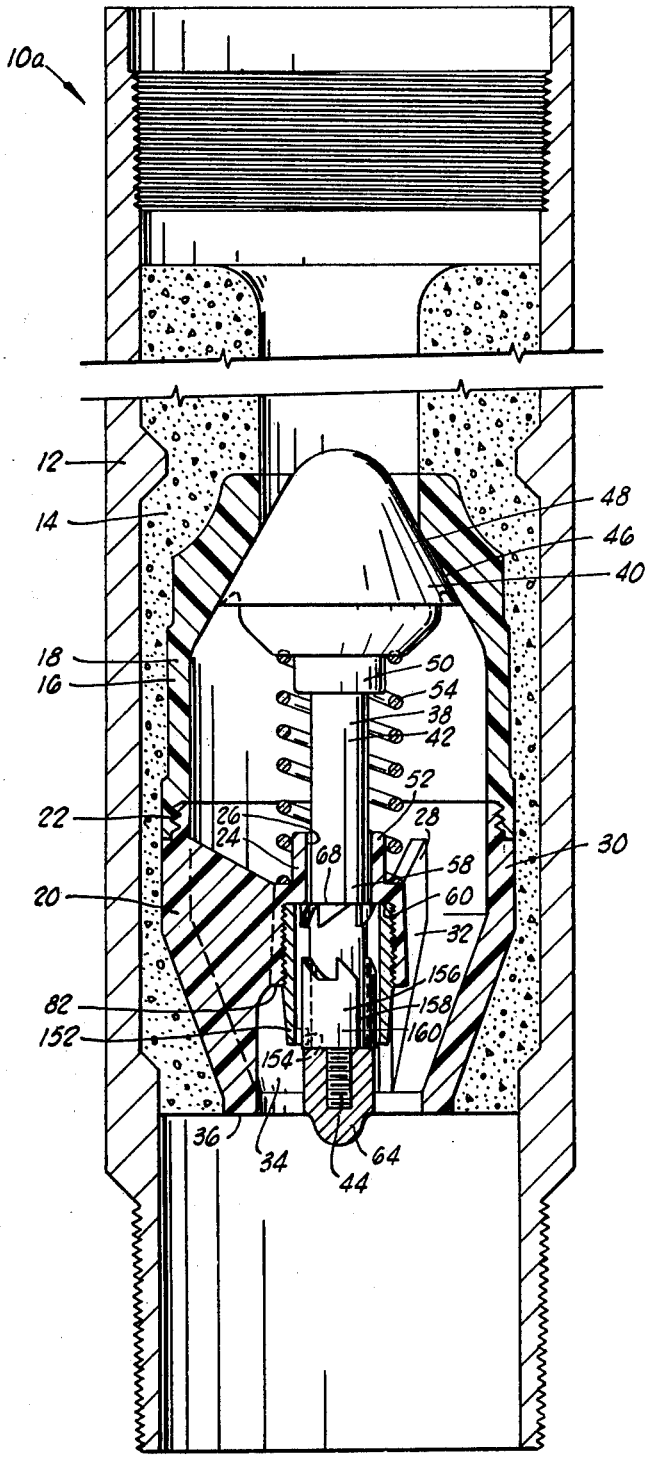
FIG. 8 is a vertical cross-sectional view of an alternate embodiment of the indexing J-slot automatic fill-up valve apparatus of the present invention.

FIG. 8 illustrates a slightly modified float collar 10*a* in which an insert 152 includes a plurality of radially inwardly extending lugs 154. The insert 152 is threaded into the internally threaded portion 80 of the valve guide 24 in a manner as described above for the tubular J-slot insert 86.

A J-slot indexing sleeve 156 is journaled on the valve stem 42 in a manner identical to that previously described for the tubular indexing sleeve 62. The J-slot indexing sleeve 156 includes a continuous cam slot 158 formed in the substantially cylindrical outer periphery 160 thereof. The configuration of the continuous cam slot 158 is substantially identical to, but radially inverted from the continuous cam slot configuration illustrates at 94 in the tubular J-slot insert 86.

It will be readily understood that the relative operation between the cam slot 158 of the J-slot indexing sleeve 156 and the inwardly extending lugs 154 of the insert 152 is substantially identical to that previously described above for the tubular indexing sleeve 62 and the tubular J-slot insert 86.

The operation of the float collar 10*a* is clearly evident from the operation of the float collar 10 described in detail above and, therefore, need not be explained again.

The advantages achieved in the employment of either embodiment of this invention are believed readily apparent in that operational control of the valve structure of the float collars 10 and 10*a* is accomplished without necessitating the shearing or deformation of materials with the accompanying inherent unreliability of such shearing or deformation. The present invention requires only the action of downward forward fluid flow against the upward bias of a compression coil spring to alternately lock the check valve structure in a retained open position and release the check valve structure to seal against any reverse upward fluid flow through the float collar. Further, both embodiments of the present invention permit a recycling of the valve structure from a locked open position, to a closed position, and back to a locked open position an unlimited number of times. Such flexibility of operation is not achievable by any of the known prior art float shoes or collars.

All of the parts of the present invention within the housing 12 may be constructed of easily drilled materials such as concrete, plastic, rubber, aluminum, cast iron and brass, to allow the collar to be drilled out after a cementing operation has been completed and the cement has set. The drilling out leaves a full-open passage through the collar to pass other tools down the casing for further work, production or testing.

Although specific preferred embodiments of the present invention have been described in the detailed description above, the description is not intended to limit the invention to the particular forms or embodiments disclosed herein, since they are to be recognized as illustrative rather than restrictive and it will be obvious to those skilled in the art that the invention is not so limited. For instance, it is contemplated that different numbers of vanes could be used between the valve guide and the lower body to vary the number and size of the ports through the collar. It would also be possible to employ the valve structure disclosed herein in the construction of a float shoe for installation on the lower end of a casing string.

In a similar manner, it will be understood that the valve structure of the present invention could be modified to employ a single J-slot and a single lug or any other number of J-slots and lugs, depending on the particular size of the tool. Further, the configuration of the J-slots could be modified so as to provide a locked-closed position, two consecutive closed positions, two consecutive open positions, or any other combination of open and closed positions desired in view of the particular well bore operations to be performed.

It will also be understood that the valve stem of the valve structure disclosed herein may be splined to the valve body to positively prevent any relative rotation therebetween. Additionally, those skilled in the art will perceive that various other forms of valve structures could be employed in the present invention, such structures including a ball valve member, a sleeve valve member, a flapper valve member or other suitable type of valve member if desired.

The invention is declared to cover all changes and modifications of the specific examples of the invention herein disclosed for purposes of illustration, which do not constitute departures from the spirit and scope of the invention.

What is claimed is:

1. A flow responsive fluid check valve for controlling forward and reverse fluid flow through a conduit, comprising:

a valve body having a substantially longitudinally aligned passage therethrough;

means for connecting said valve body in a conduit;

a valve seat disposed in the passage in said valve body and facing in the direction of forward fluid flow through said valve body;

valve member means having a valve stem formed thereon and extending in longitudinal alignment with said valve body, said valve member means being movably disposed in the passage in said valve body for engagaing said valve seat to close said fluid check valve to reverse fluid flow and, alternately, for disengaging from said valve seat to open said fluid check valve to reverse fluid flow;

biasing means operatively engaging said valve member means for urging said valve member means toward said valve seat; and flow responsive means operatively mutually engaging said valve body and said valve member means, said flow responsive means including:

an indexing sleeve secured to said valve stem and having at least one outwardly extending protuberance formed thereon, and J-slot means carried by said valve body, and having a longitudinal passage formed therein in which said indexing sleeve is slidably received and having a cam slot formed therein in which the protuberance is slidably received, for engaging the protuberance to retain said valve member means disengaged from said valve seat against the urging of said biasing means to thereby allow reverse fluid flow through the passage in said valve body, for releasing said valve member means for engagement with said valve seat under the urging of said biasing means in response to an application of foward fluid flow through the passage in said valve body to thereby prevent reverse fluid flow therethrough, and for again retaining said valve member means disengaged from said valve seat against the urging of said biasing means in response to another application of forward fluid flow through the passage in said valve body to thereby again allow reverse fluid flow therethrough.

2. The flow responsive fluid check valve as defined in claim 1 wherein said flow responsive means permits an unlimited number of cyclings of said valve member means between engagement with and retained disengaged from said valve seat in response to separate applications of forward fluid flow through the passage in said valve body.

3. A flow responsive fluid check valve for controlling forward and reverse fluid through a conduit, comprising:

a valve body having a substantially longitudinally aligned passage therethrough;

means for connecting said valve body in a conduit;

a valve seat disposed in the passage in said valve body and facing in the direction of forward fluid flow through said valve body;

valve member means having a valve stem formed thereon and extending in axial alignment within the passage in said valve body, said valve member means being movably disposed in the passage in said valve body for engaging said valve seat to close said fluid check valve to reverse fluid flow and, alternately, for disengaging from said valve seat to open said fluid check valve to reverse fluid flow;

biasing means operatively engaging said valve member means for urging said valve member means toward said valve seat; and flow responsive means operatively mutually engaging said valve body and said valve member means, said flow responsive means including:

valve guide means carried by said valve body for guiding said valve member means, said valve guide means having a longitudinal passage formed therein within which said valve stem extends and including at least one inwardly extending protuberance formed within the longitudinal passage thereof; and a J-slot indexing sleeve secured to said valve stem and disposed within the longitudinal passage of said valve guide means, said J-slot indexing sleeve having a cam slot formed on the outer periphery thereof in which the protuberance is slidably received, for engaging the protuberance to retain said valve member means disengaged from said valve seat against the urging of said biasing means to thereby allow reverse fluid flow through the passage in said valve body, for releasing said valve member means for engagement with said valve seat under the urging of said biasing means in response to an application of forward fluid flow through the passage in said valve body to thereby prevent reverse fluid flow therethrough, and for again retaining said valve member means disengaged from said valve seat against the urging of said biasing means in response to another application of forward fluid flow through the passage in said valve body to thereby again allow reverse fluid flow therethrough.

4. The flow responsive fluid check valve as defined in claim 3 wherein said J-slot indexing sleeve is journaled on said valve stem.

5. A flow responsive fluid check valve for controlling forward and reverse fluid flow through a conduit, comprising:

a valve body having a substantially longitudinally aligned passage therethrough;

means for connecting said valve body in a conduit;

a valve seat disposed in the passage in said valve body and facing in the direction of forward fluid flow through said valve body;

valve member means having a valve stem formed thereon and extending in axial alignment within the passage in said valve body, said valve member means being movably disposed in the passage in said valve body for engaging said valve seat to close said fluid check valve to reverse fluid flow and, alternately, for disengaging from said valve seat to open said fluid check valve to reverse fluid flow;

biasing means operatively engaging said valve member means for urging said valve member means toward said valve seat; and flow responsive means operatively mutually engaging said valve body and said valve member means, said flow responsive means including:

an indexing sleeve journaled on said valve stem and having a plurality of outwardly extending, cam-following protuberances formed thereon; and J-slot means carried by said valve body, and having a longitudinal passage formed therein in which said indexing sleeve is slidably received and having a continuous cam slot formed therein in which each of the plurality of protuberances is slidably received, for engaging the plurality of protuberances to retain said valve member means disengaged from said valve seat against the urging of said biasing means to thereby allow reverse fluid flow through the passage in said valve body, for releasing said valve member means for engagement with said valve seat under the urging of said biasing means in response to an application of forward fluid flow through the passage in said valve body to thereby prevent reverse fluid flow therethrough, and for again retaining said valve member means disengaged from said valve seat against the urging of said biasing means in response to another application of forward fluid flow through the passage in said valve body to thereby again allow reverse fluid flow therethrough.

6. The valve apparatus as defined in claim 5 wherein said flow responsive means permits an unlimited number of cyclings of said valve member means between engagement with and retained disengagement from said valve seat in response to separate applications of downward fluid flow through said tubular body.

7. Valve apparatus for controlling downward forward flow and upward reverse flow of a fluid through a pipe string in a well, comprising:

a tubular body;

means for connecting said tubular body in a pipe string in coaxial communication therewith;

a valve seat disposed in said tubular body facing downwardly in the direction of forward fluid flow;

valve member means having a valve stem formed thereon and extending in axial alignment within said tubular body, said valve member means being movably disposed in said tubular body for engaging said valve seat to close said tubular body to upward reverse fluid flow therethrough, and alternatively, for disengaging from said valve seat to open said tubular body to upward reverse fluid flow therethrough;

biasing means operatively engaging said valve member means for urging said valve member means toward said valve seat; and flow responsive means operatively mutually engaging said tubular body and said valve member means, said flow responsive means including:

an indexing sleeve secured to said valve stem and having at least one outwardly extending protuberance formed thereon; and J-slot means carried by said tubular body, and having a longitudinal passage formed therein in which said indexing sleeve is slidably received and having a cam slot formed therein in which the protuberance is slidably received, for engaging the protuberance to retain said valve member means disengaged from said valve seat against the urging of said biasing means to thereby allow upward reverse fluid flow through said tubular body, for releasing said valve member means for engagement with said valve seat under the urging of said biasing means in response to an application of downward forward fluid flow through said tubular body to thereby prevent upward reverse fluid flow therethrough, and for again retaining said valve member means disengaged from said valve seat against the urging of said biasing means in response to another application of downward forward fluid flow through said tubular body to thereby again allow upward reverse fluid flow therethrough.

8. The valve apparatus as defined in claim 7 wherein said indexing sleeve is journaled on said valve stem.

9. Valve apparatus for controlling downward forward flow and upward reverse flow of a fluid through a pipe string in a well, comprising:

a tubular body;

means for connecting said tubular body in a pipe string in coaxial communication therewith;

a valve seat disposed in said tubular body facing downwardly in the direction of forward fluid flow;

valve member means having a valve stem formed thereon and extending in axial alignment within said tubular body, said valve member means being movably disposed in said tubular body for engaging said valve seat to close said tubular body to upward reverse fluid flow therethrough and, alternately, for disengaging from said valve seat to open said tubular body to upward reverse fluid flow therethrough;

biasing means operatively engaging said valve member means for urging said valve member means toward said valve seat; and flow responsive means operatively mutually engaging said valve body and said valve member means, said flow responsive means including:

valve guide means carried by said tubular body for guiding said valve member means, said valve guide means having a longitudinal passage formed therein within which said valve stem extends and including at least one inwardly extending protuberance formed within the longitudinal passage thereof; and a J-slot indexing sleeve secured to said valve stem and disposed within the longitudinal passage of said valve guide means, said J-slot indexing sleeve having a cam slot formed on the outer periphery thereof in which the protuberance is slidably received for engaging the protuberance to retain said valve member means disposed from said valve seat against the urging of said biasing means to thereby allow upward reverse fluid flow through said tubular body, for releasing said valve member means for engagement with said valve seat under the urging of said biasing means in response to an application of downward forward fluid flow through said tubular body to thereby prevent upward reverse fluid flow therethrough, and for again retaining said valve member means disengaged from said valve seat against the urging of said biasing means in response to another application of downward forward fluid flow through said tubular body to thereby again allow reverse fluid flow therethrough.

10. The valve apparatus as defined in claim 9 wherein said J-slot indexing sleeve is journaled on said valve stem.

11. Valve apparatus for controlling downward forward flow and upward reverse flow of a fluid through a pipe string in a well, comprising:

a tubular body;

means for connecting said tubular body in a pipe string in coaxial communication therewith;

a valve seat disposed in said tubular body facing downwardly in the direction of forward fluid flow;

valve member means having a valve stem formed thereon and extending in axial alignment within said tubular body, said valve member means being movably disposed in said tubular body for engaging said valve seat to close said tubular body to upward reverse fluid flow therethrough and, alternately, for disengaging from said valve seat to open said tubular body to upward reverse fluid flow therethrough;

biasing means operatively engaging said valve member means for urging said valve member means toward said valve seat; and flow responsive means operatively mutually engaging said valve body and said valve member means, said flow responsive means including:

an indexing sleeve journaled on said valve stem and having a plurality of outwardly extending, cam-following protuberances formed thereon; and J-slot means carried by said tubular body, and having a longitudinal passage formed therein in which said indexing sleeve is slidably received and having a continuous cam slot formed therein in which each of the plurality of protuberances is slidably received, for engaging the plurality of protuberances to retain said valve member means disengaged from said valve seat against the urging of said biasing means to thereby allow upward reverse fluid flow through said tubular body, for releasing said valve member means for engagement with said valve seat under the urging of said biasing means in response to an application of downward forward fluid flow through said tubular body to thereby prevent upward reverse fluid flow therethrough, and for again retaining said valve member means disengaged from said valve seat against the urging of said biasing means in response to another application of downward forward fluid flow through said tubular body to thereby again allow upward reverse fluid flow therethrough.

12. The valve apparatus as defined in claim 11 wherein said biasing means is characterized further to include a compression coil spring mutually operatively engaging said valve member means and said tubular body.

13. The valve apparatus as defined in claim 11 wherein the plurality of outwardly extending, cam-following protuberances formed on said indexing sleeve are characterized further to include:

three circumferentially spaced, radially outwardly extending lugs formed on the outer periphery of said indexing sleeve; and wherein the continuous cam slot formed in said J-slot means is characterized further to include:

three lug-engaging detents formed therein for simultaneously engaging the three radially outwardly extending lugs of said indexing sleeve for retaining said valve member means disengaged from said valve seat against the urging of said biasing means to thereby allow upward reverse fluid flow through said tubular body, and three longitudinal slot portions formed therein for allowing longitudinal movement of said radially outwardly extending lugs therethrough to release said valve member means for engagement with said valve seat under the urging of said biasing means to thereby prevent upward reverse fluid flow through said tubular body.

14. In a flow responsive fluid check valve for controlling forward and reverse fluid flow through a conduit of the type which includes a tubular body; means for connecting said tubular body in a conduit; a valve seat disposed in said tubular body facing in the direction of forward fluid flow through said tubular body; valve member means having a valve stem formed thereon and extending in longitudinal alignment within said tubular body said valve member means being movably disposed in said tubular body for engaging said valve seat to close said fluid check valve to reverse fluid flow and, alternately, for disengaging from said valve seat to open said fluid check valve to reverse fluid flow; and biasing means operatively engaging said valve member means for urging said valve member means toward said valve seat; the improvement comprising:

flow responsive means operatively, mutually engaging said tubular body and said valve member means, said flow responsive means including:

an indexing sleeve secured to said valve stem and having at least one outwardly extending protuberance formed thereon; and J-slot means carried by said tubular body, and having a longitudinal passage formed therein in which said indexing sleeve is slidably received and having a cam slot formed therein in which the protuberance is slidably received, for engaging the protuberance to retain the valve member means disengaged from said valve seat against the urging of said biasing means to thereby allow reverse fluid flow through said tubular body, for releasing said valve member means for engagement with said valve seat under the urging of said biasing means in response to an application of forward fluid flow through said tubular body to thereby prevent reverse fluid flow therethrough, and for again retaining said valve member means disengaged from said valve seat against the urging of said biasing means in response to another application of forward fluid flow through said tubular body to thereby again allow reverse fluid flow therethrough.

15. The flow responsive fluid check valve as defined in claim 14 wherein said flow responsive means permits an unlimited number of cyclings of said valve member means between engagement with and retained disengagement from said valve seat in response to separate applications of forward fluid flow through said tubular body.

16. In a flow responsive fluid check valve for controlling forward and reverse fluid flow through a conduit of the type which includes a tubular body; means for connecting said tubular body in a conduit; a valve seat disposed in said tubular body facing in the direction of forward fluid flow through said tubular body; valve member means having a valve stem formed thereon and extending in axial alignment within said tubular body said valve member means being disposed in said tubular body for engaging said valve seat to close said fluid check valve to reverse fluid flow and, alternately, for disengaging from said valve seat to open said fluid check valve to reverse fluid flow; and biasing means operatively engaging said valve member means for urging said valve member means toward said valve seat; the improvement comprising:

flow responsive means operatively mutually engaging said tubular body and said valve means, said flow responsive means including:

valve guide means carried by said tubular body for guiding said valve member means, said valve guide means having a longitudinal passage formed therein within which said valve stem extends and including at least one inwardly extending protuberance formed within the longitudinal passage thereof; and a J-slot indexing sleeve secured to said valve stem and disposed within the longitudinal passage of said valve guide means, said J-slot indexing sleeve having a cam slot formed on the outer periphery thereof in which the protuberance is slidably received, for engaging the protuberance to retain said valve member means disengaged from said valve seat against the urging of said biasing means to thereby allow reverse fluid flow through said tubular body, for releasing said valve member means for engagement with said valve seat under the urging of said biasing means in response to an application of forward fluid flow through said tubular body to thereby prevent reverse fluid flow therethrough, and for again retaining said valve member means disengaged from said valve seat against the urging of said biasing means in response to another application of forward fluid flow through said tubular body to thereby again allow reverse fluid flow therethrough.

17. The flow responsive fluid check valve as defined in claim 16 wherein said J-slot indexing sleeve is journaled on said valve stem.

18. In a flow responsive fluid check valve for controlling forward and reverse fluid flow through a conduit of the type which includes a tubular body; means for connecting said tubular body in a conduit; a valve seat disposed in said tubular body facing in the direction of forward fluid flow through said tubular body; valve member means having a valve stem formed thereon and extending in axial alignment within said tubular body said valve member means being disposed in said tubular body for engaging said valve seat to close said fluid check valve to reverse fluid flow and, alternately, for disengaging from said valve seat to open said fluid check valve to reverse fluid flow; and biasing means operatively engaging said valve member means for urging said valve member means toward said valve seat; the improvement comprising:

flow responsive means operatively mutually engaging said tububular body and said valve member means, said flow responsive means including:

an indexing sleeve journaled on said valve stem and having a plurality of outwardly extending, cam-following protuberances formed thereon; and J-slot means carried by said tubular body, and having a longitudinal passage formed therein in which said indexing sleeve is slidably received and having a continuous cam slot formed therein in which each of the plurality of protuberances is slidably received, for engaging the plurality of protuberances to retain said valve member means disengaged from said valve seat against the urging of said biasing means to thereby allow reverse fluid flow through said tubular body, for releasing said valve member means for engagement with said valve seat under the urging of said biasing means in response to an application of forward fluid flow through said tubular body to thereby prevent reverse fluid flow therethrough, and for again retaining said valve member means disengaged from said valve seat against the urging of said biasing means in response to another application of forward fluid flow through said tubular body to thereby again allow reverse fluid flow therethrough.

* * * * *